US011731183B2

(12) United States Patent
Gearhart et al.

(10) Patent No.: US 11,731,183 B2
(45) Date of Patent: Aug. 22, 2023

(54) SMOOTHING ROLLER ASSEMBLY

(71) Applicant: BELVAC PRODUCTION MACHINERY, INC., Lynchburg, VA (US)

(72) Inventors: Brian S. Gearhart, Huddleston, VA (US); Erika Sheaffer Love, Lynchburg, VA (US); Gerald Meador, Hardy, VA (US)

(73) Assignee: BELVAC PRODUCTION MACHINERY, INC., Lynchburg, VA (US)

( * ) Notice: Subject to any disclaimer, the term of this patent is extended or adjusted under 35 U.S.C. 154(b) by 230 days.

(21) Appl. No.: 15/755,787

(22) PCT Filed: Aug. 31, 2016

(86) PCT No.: PCT/US2016/049650
§ 371 (c)(1),
(2) Date: Feb. 27, 2018

(87) PCT Pub. No.: WO2017/044362
PCT Pub. Date: Mar. 16, 2017

(65) Prior Publication Data

US 2018/0326469 A1 Nov. 15, 2018

Related U.S. Application Data

(60) Provisional application No. 62/215,452, filed on Sep. 8, 2015.

(51) Int. Cl.
*B21D 51/26* (2006.01)
*B21D 1/08* (2006.01)

(52) U.S. Cl.
CPC ..... *B21D 1/08* (2013.01); *B21D 51/2615* (2013.01); *B21D 51/2638* (2013.01)

(58) Field of Classification Search
CPC .. B21D 1/08; B21D 51/2615; B21D 51/2638; B21D 22/00; B21D 31/001; B21D 22/28;
(Continued)

(56) References Cited

U.S. PATENT DOCUMENTS 2,239,696 A * 4/1941 Bohm ..... B21D 51/2638 72/70
3,811,306 A * 5/1974 Yoshimura ..... B21D 51/2615 72/126

(Continued)

FOREIGN PATENT DOCUMENTS

DE 1265107 B * 4/1968
JP 63-16823 A * 1/1988 ..... B21D 51/26

(Continued)

OTHER PUBLICATIONS

EPO English translation of JP 63-230230 (Year: 1988).*

(Continued)

*Primary Examiner* — Edward T Tolan
(74) *Attorney, Agent, or Firm* — Nixon Peabody LLP

(57) ABSTRACT

A turret head assembly for forming an article includes at least one smoothing roller. Each of the at least one smoothing roller is rotatably mounted on a respective at least one roller support member. The turret head assembly further includes an upper ring member and a lower ring member. The upper and lower ring members include respective apertures located in the centers thereof. The at least one roller support member extends between the upper ring member and the lower ring member. The turret head assembly further includes a turret head-assembly support member defining a turret-head axis. The turret-head-assembly member extends through the respective apertures in the upper and lower ring members.

16 Claims, 7 Drawing Sheets

(58) Field of Classification Search
CPC ..... B21D 43/14; B21D 31/00; B21D 51/38; B21D 22/16; B21D 51/2607; B21D 22/185
USPC ..... 72/67
See application file for complete search history.

(56) References Cited

U.S. PATENT DOCUMENTS

| | | | | |
|---|---|---|---|---|
| 5,353,619 | A * | 10/1994 | Chu | B21D 51/2638 72/126 |
| 7,950,259 | B2 * | 5/2011 | Marshall | B21D 51/2615 72/70 |
| 9,643,229 | B2 * | 5/2017 | Wilson | B23D 31/001 |
| 2007/0017089 | A1 * | 1/2007 | Hosoi | B21D 51/2615 29/801 |
| 2007/0227218 | A1 | 10/2007 | Shortridge | |
| 2018/0326469 | A1 * | 11/2018 | Gearhart | B21D 1/08 |

FOREIGN PATENT DOCUMENTS

| | | | |
|---|---|---|---|
| JP | S63230230 | A | 9/1988 |
| JP | A2003-285132 | A | 10/2003 |
| JP | U43-0232717 | B2 | 9/2009 |
| JP | O2018-531296 | A | 10/2018 |
| WO | 2015131114 | A1 | 9/2015 |

OTHER PUBLICATIONS

International Search Report from International Application No. PCT/US2016/049650 dated Nov. 29, 2016.
Japanese Office Action in Japanese Patent Application No. JP 2018-531296, dated Sep. 7, 2020 (1 page) (with English translation).

* cited by examiner

SMOOTHING ROLLER ASSEMBLY

CROSS-REFERENCE TO RELATED APPLICATION(S)

This application is a U.S. National Stage of International Application No PCT/US2016/049650, filed on Aug. 31, 2016, which claims priority to U.S. Provisional Patent Application Ser. No. 62/215,542, filed on Sep. 8, 2015, both of which are incorporated herein by reference in their entireties.

BACKGROUND

In the industry, beverage containers for various soft drinks and/or beer are produced in large quantities and relatively economically in substantially identical shapes. There is an increasing desire among beverage manufacturers to sell products from economical containers having unique configurations to assist in differentiating their products from their competitors.

Conventional beverage containers are typically formed from a pre-form, generally cylindrical metal article/container made from an aluminum or aluminum alloy sheet, surface-treated steel, a combination thereof, or the like. The pre-form article typically undergoes multiple expansion or reduction iterations to achieve a desired shape. Multiple diametrical reductions to an open end of the pre-form article may be performed, for example, to form a narrow neck portion of the container, such as in a bottle-shaped container configuration. Due to limitations associated with the metal used to form the containers, the diametrical reductions can only be performed incrementally or in incremental "stages." Each stage of reduction typically results in wavy-looking "witness mark" on the neck of the article. These witness marks are undesirable because they are generally visible in the finished product, thereby preventing the neck portion from having an aesthetically pleasing, smooth surface.

It is an object of the embodiments disclosed herein to produce aesthetically pleasing formed articles having a smooth taper where witness marks are substantially less visible or not generally visible to the end user. The embodiments provide new systems and methods for smoothing witness marks from formed articles.

SUMMARY

According to aspects disclosed herein, a turret head assembly for forming an article includes at least one smoothing roller, each of the at least one smoothing roller being rotatably mounted on a respective at least one roller support member. The turret head assembly further includes an upper ring member and a lower ring member, the upper and lower ring members including respective apertures located in the centers thereof, the at least one roller support member extending between the upper ring member and the lower ring member. The turret head assembly further includes a turret head-assembly support member defining a turret-head axis, the turret-head-assembly member extending through the respective apertures in the upper and lower ring members.

According to further aspects of the disclosed herein, a method of forming a necked article includes engaging a necked article having witness marks thereon by a turret head assembly, the turret head assembly including an upper ring member, a lower ring member, and at least one roller support member extending between the upper ring member and the lower ring member, each of the at least one roller support members having at least one smoothing roller rotatably mounted thereon, the at least one smoothing roller having a smoothing portion having a complementary shape to the desired shape of a necked portion of the necked article. The method further includes rotating the turret head assembly about a turret-head axis such that the at least one smoothing roller freely rotates about the respective at least one roller support member. The method further includes engaging the smoothing portion of the at least one smoothing roller with at least a portion of a necked portion of the necked article, thereby smoothing the witness marks on the necked article.

These and other capabilities of the invention, along with the invention itself, will be more fully understood after a review of the following figures, detailed description, and claims.

Figure 2C:
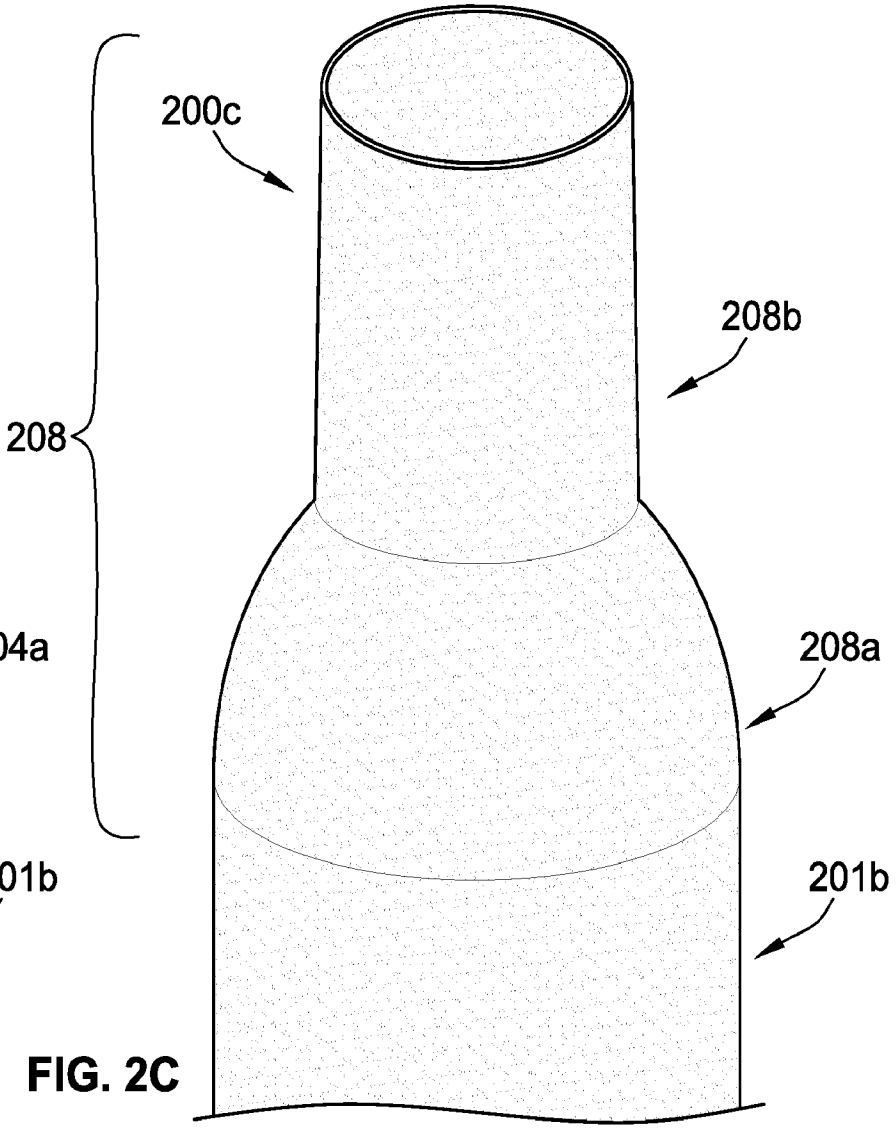
FIG. 2C illustrates the necked article of FIG. 2B after the witness marks have been smoothed, according to aspects of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation." Additionally, the singular terms "a," "an," and "the" include plural referents unless context clearly indicates otherwise.

Existing container expansion and reduction processes and apparatus suffer from a number of significant limitations. In particular, for example, the processes and tools used to diametrically expand or reduce the container may result in an uneven surface that may include bumps, waves, witness marks, and the like. Such an uneven surface is undesirable because, for example, it is not as aesthetically pleasing as a smooth surface.

According to aspects of the present disclosure, apparatus and methods are described for improving article (e.g., container) diametric expansion and reduction processes. Although the embodiments described herein are discussed with respect to diametric reduction processes, it is contemplated that the smoothing rollers and the methods of using the same may also be applied in association with article expansion processes or any other process that results in an uneven (e.g., not smooth) container surface.

The articles described herein may be a can, any suitable food or beverage container, jar, bottle, or any other suitable article. The article has an open end opposite a closed end and a sidewall bridging the open end and the closed end. Alternatively, the article may be open at both ends. A top, lid, or other closure may be added to the article after the expansion or reduction process.

For exemplary purposes only, the below description will describe a reduction apparatus and methods for use on a container. It will be recognized that the methods and apparatus described herein may be used with any suitable article.

Figure 1:
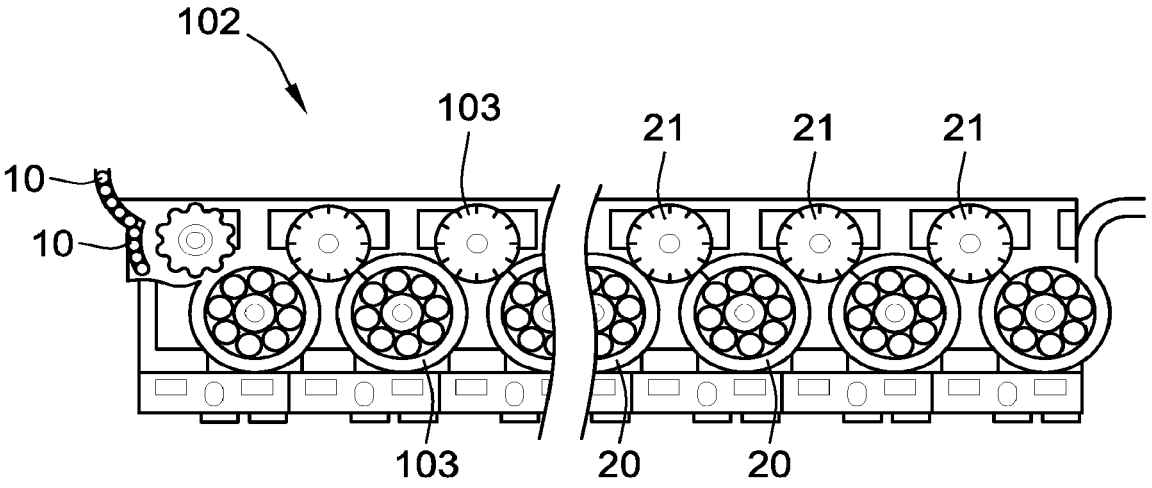
FIG. 1 illustrates a machine line for forming articles according to one embodiment.

Referring now to FIG. 1, an exemplary machine line 102 for forming articles is shown. The machine line 102 includes a plurality of modules 103. Each module 103 is configured to perform at least one working step to a received article 10 prior to passing the article downstream. The modules 103 generally include one or more forming turrets configured to perform a working operation on the article. The forming turret(s) generally include at least one forming starwheel (e.g., forming turret 21) having a plurality of pockets and tooling configured to perform the working operation on an article within a respective pocket.

Modules 103 generally further include at least one transfer starwheel (e.g., transfer starwheels 20) having a plurality of pockets thereon. The pockets are configured to receive the articles from an upstream starwheel and transport the article to a downstream starwheel. Optionally, a recirculation system can be employed. An example recirculation system is described in PCT/US2015/018119, which is hereby incorporated by reference in its entirety.

Figure 2B:
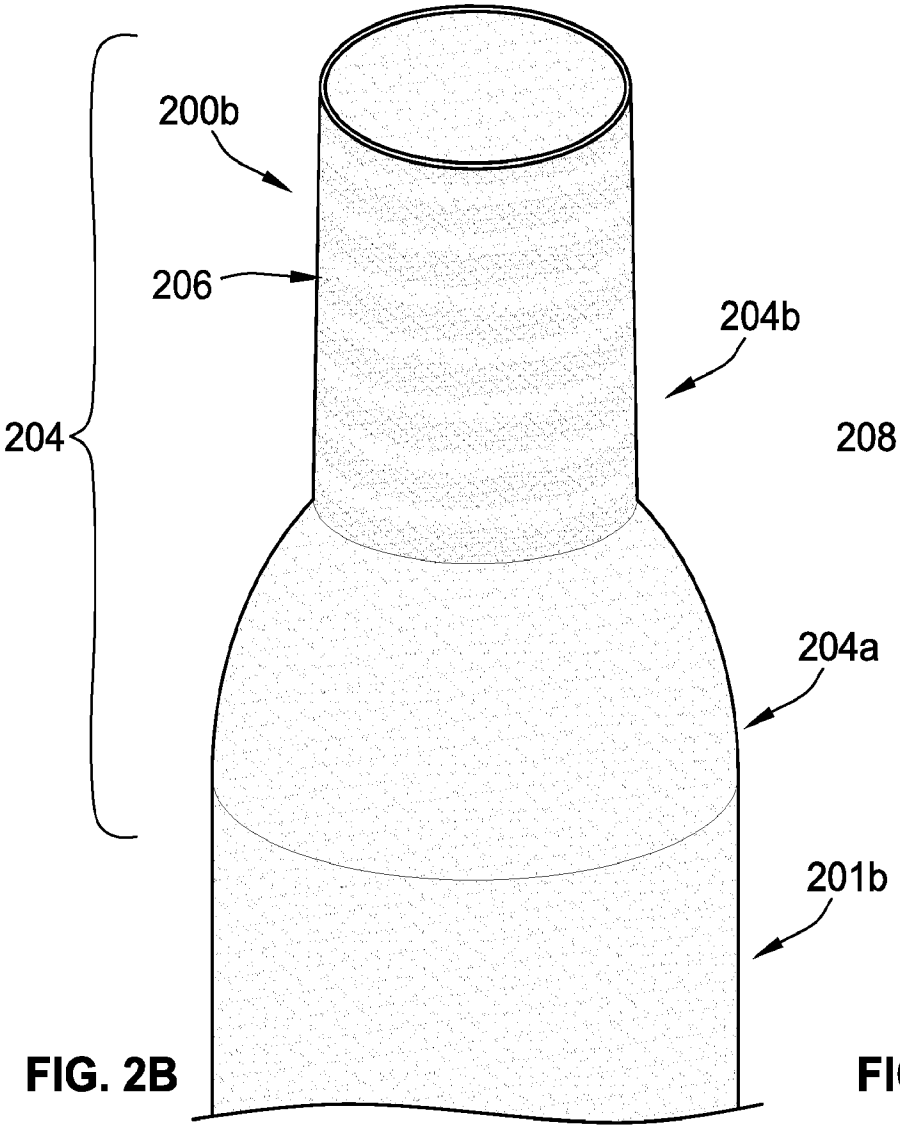
FIG. 2B illustrates a necked article formed from the pre-form article of FIG. 2A, including visible witness marks resulting from diametrical reduction iterations during neck-forming operations.
Figure 2A:
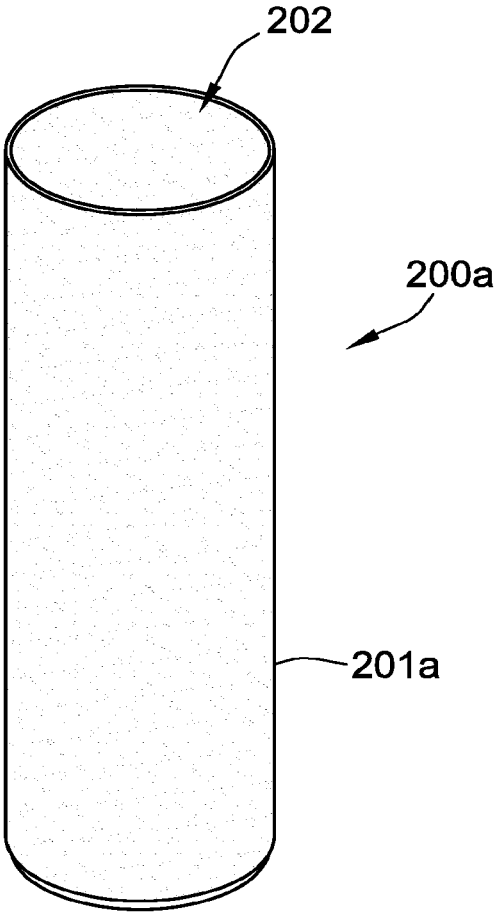
FIG. 2A illustrates a pre-form article according to one embodiment.

Referring now to FIG. 2A, a pre-form article 200*a* is shown. The pre-form article 200*a* includes a generally cylindrical body 201*a* having an open end 202. As the pre-form article 200*a* is passed downstream, working operations are performed to the open end 202.

FIG. 2B illustrates a necked article 200*b* including a narrowed neck portion 204 extending from the generally cylindrical body 201*b*. According to the illustrated embodiment, the neck portion 204 has a radiused portion 204*a* and a tapered portion 204*b*. During necking procedures, the open end 202 of the pre-form article 200*a* (see FIG. 2A) is diametrically reduced in stages to form the neck portion 204. The necking procedure is performed in stages to assist in preventing misforming or breaching of the necked article 200*b*. Engagement of the tooling with the neck portion 204 during each stage of the necking procedure results in at least one visible witness mark 206 for each diametrical reduction. Accordingly, each of the radiused and tapered portions 204*a*, 204*b* may include a plurality of witness marks 206.

Referring now to FIG. 2C, a smooth-necked article 200*c* is shown. The smooth-necked article 200*c* is produced by smoothing the witness marks 206 of the necked article 200*b* of FIG. 2B. The smoothing results in reducing or eliminating the witness marks 206 of the radiused and/or tapered portions 208*a*, 208*b* of the necked portion 208 such that the witness marks 206 are substantially less visible or generally not visible in the smooth-necked article 200*c*.

Figure 3:
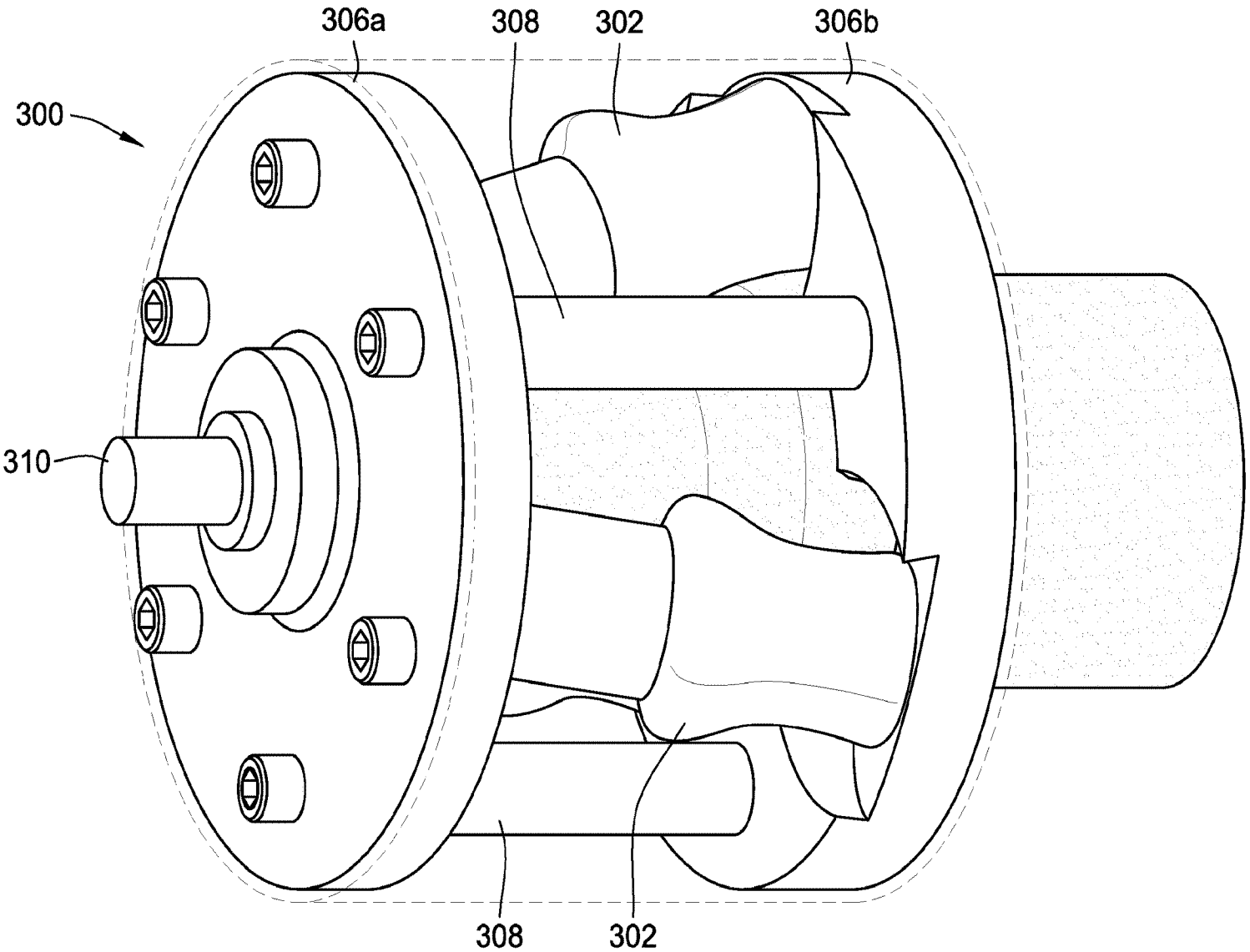
FIG. 3 illustrates a turret head assembly including smoothing rollers according to aspects of the present disclosure.

FIG. 3 illustrates an example of a turret head assembly 300 according to aspects of the present disclosure. The turret head assembly 300 includes independently rotating smoothing rollers 302, roller support members 304 (see FIG. 4), an upper ring member 306*a*, a lower ring member 306*b*, ring-spacing members 308, and a turret head-assembly support member 310. Each of the smoothing rollers 302 is rotatably mounted on a respective roller support member 304. The smoothing rollers 302 freely rotate about a roller axis defined by the roller support member 304. The turret head assembly 300 may include any suitable number of smoothing rollers 302. In one embodiment, the turret head assembly 300 includes three smoothing rollers 302. In another embodiment, the turret head assembly 300 includes five smoothing rollers 302.

Figure 4:
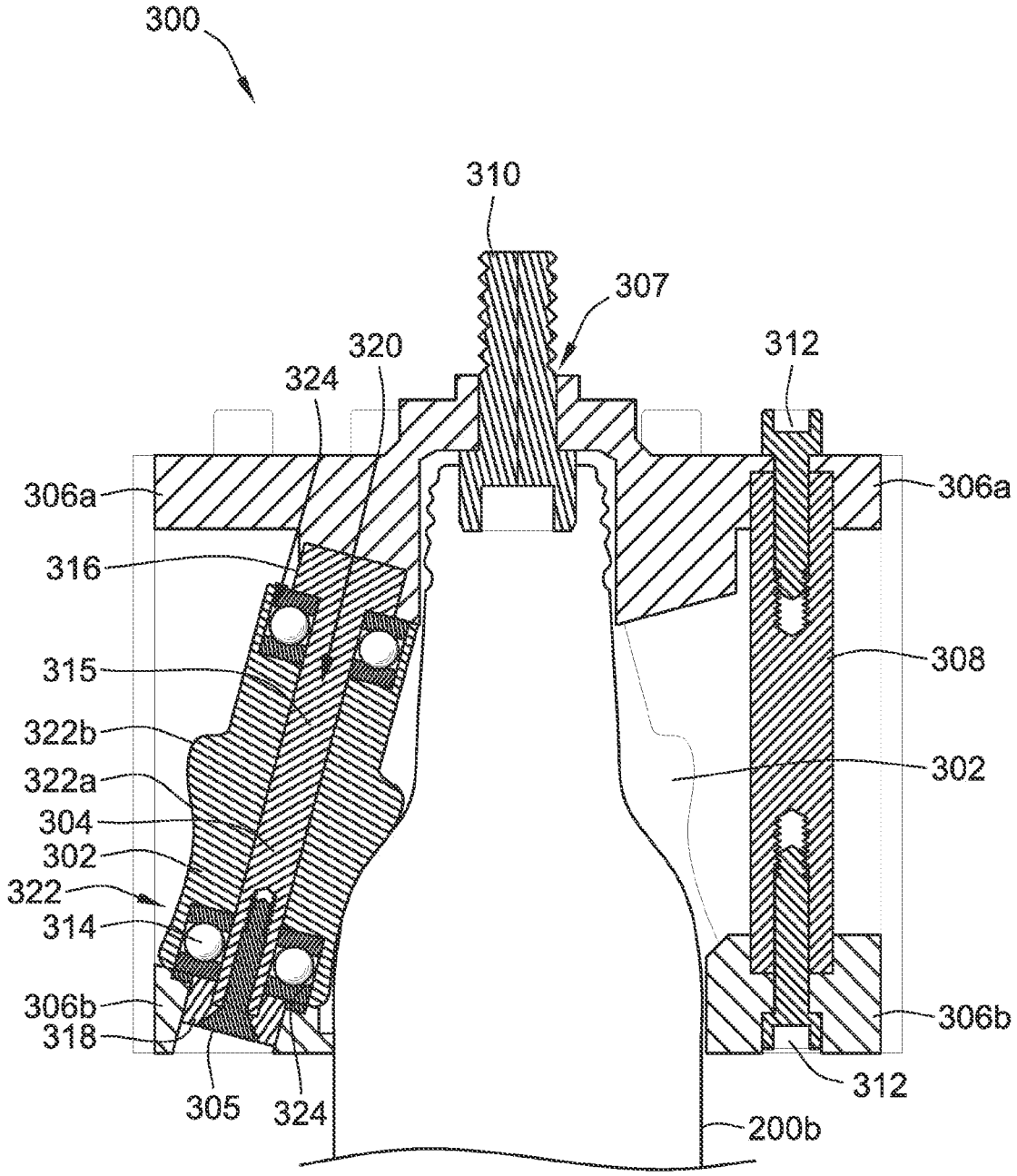
FIG. 4 illustrates a cross-sectional view of the turret head assembly of FIG. 3.

FIG. 4 illustrates a cross-sectional view of the turret head assembly of FIG. 3. The upper and lower ring members 306*a*, 306*b* include respective apertures 307 located in the centers thereof through with the turret head-assembly support member 310 extends. As shown in FIG. 4, the roller support members 304 extend between the upper ring member 306*a* and the lower ring member 306*b*. The roller support members 304 can be mounted on the ring members 306*a*, 306*b* using any suitable method. For example, each end of the roller support members 304 may be configured to be received by recesses in the upper and lower ring members 306*a*, 306*b*. Additionally or alternatively, fasteners 305 may be used to secure the roller support members 304 to the upper and lower ring members 306*a*, 306*b*. The fasteners 305 may extend through apertures in the upper and lower ring members 306*a*, 306*b* to engage a respective end of the roller support members 304. Additionally or alternatively, ends of the roller support members 304 and respective recesses in the upper and lower ring members 306*a*, 306*b* may be threaded such that the roller support members 304 threadably engage the upper and lower ring members 306*a*, 306*b*.

The ring-spacing members 308 extend between the upper ring member 306*a* and the lower ring member 306*b*. The ring-spacing members 308 are configured to dispose and maintain the upper ring member 306*a* a predetermined distance from the lower ring member 306*b*. The ring-spacing members 308 may be mounted to the upper and lower ring members 306*a*, 306*b* using a variety of methods, such as, for example, those discussed above with respect to the roller support members 304.

The turret head-assembly support member 310 is configured to support the turret head assembly 300 on the forming turret (e.g., forming turret 21 of FIG. 1). The turret head assembly 300 is configured to rotate about a turret-head axis defined by the turret head-assembly support member 310. In some embodiments, the turret head assembly 300 rotates at a speed greater than about 200 RPM. In some embodiments, the turret head assembly 300 is rotatably mounted on the turret head-assembly support member 310 such that the turret head assembly 300 rotates about the turret-head axis independent from rotation of the turret head-assembly support member 310. In some embodiments, the turret head assembly 300 is non-rotatably mounted on the turret head-assembly support member 310 such that the turret head assembly 300 rotates about the turret-head axis with rotation of the turret head-assembly support member 310.

As shown in the illustrated embodiment, the axes of roller support members 304 can be disposed at an angle relative to the turret head-assembly support member 310 and the turret-head axis. Beneficially, non-parallel angles of the roller support members 304 such as those illustrated in FIGS. 3 and 4 may be used to decrease the overall diameter of the turret head assembly 300 by reducing the clearance needed by the smoothing rollers 302.

Optionally, the turret head assembly 300 may further include a removable protective cover (not shown) generally disposed about the periphery of the upper and lower ring members 306*a*, 306*b* and extending therebetween such that the protective cover and upper and lower ring members 306*a*, 306*b* define a cavity having the smoothing rollers 302 therein. Beneficially, the protective cover may generally increase safety and/or decrease maintenance of the machine by inhibiting debris or other obstructions from entering the turret head assembly 300.

As shown in FIG. 4, the turret head-assembly support member 310 is configured to extend into the neck portion 204 of the necked article 200*b*. Beneficially, the turret head assembly 300 can include tooling to simultaneously perform operations on the necked article 200*b* such as trimming, flanging, curling, threading, etc. In some embodiments, the tooling is attached to the turret head-assembly support member 310. In some embodiments, the tooling is integrally formed with the turret head-assembly support member 308.

In the illustrated embodiment, the ring-spacing members 308 are received in respective recesses of the upper and lower ring members 306*a*, 306*b*. Engagement of the ends of the ring-spacing members 308 with the upper and lower ring members 306*a*, 306*b* determine the spacing between the upper and lower ring members 306*a*, 306*b*. The ring-support members 308 are secured to the upper and lower ring members 306*a*, 306*b* using fasteners 312. The fasteners 312 extend through passages in the upper and lower ring members 306*a*, 306*b* and engage a threaded bore of the ring-spacing member 308.

The smoothing rollers 302 are rotatably mounted on the roller support members 304. Any suitable rotatable mount can be used such as ball bearings, taper bearings, ball bearings, bushings, etc. In the illustrated example, the smoothing rollers 302 are rotatably mounted on the roller support members 304 using bearings 314 disposed along a shaft 315 of the roller support member 304.

The roller support member 304 includes an enlarged portion 316 at an upper end of the roller support member 304. The enlarged portion 316 is configured to engage the upper bearings 314 to inhibit upward movement of the bearings 314. The enlarged portion 316 is received in a respective recess of the upper ring member 306*a*.

A removable collar 318 is disposed about the shaft 315 of the roller support member 304 opposite the enlarged portion 316. The collar 318 is configured to engage the lower bearings 314 to inhibit downward movement of the bearings 314. The collar 318 is received in a respective recess of the lower ring member 306*b*. It is contemplated that the enlarged portion 316 can be replaced with a second collar 318.

The fasteners 305 secure the roller support member 304 to the lower ring member 306*b*. The fasteners 305 extend through passages in the roller support members 304.

The smoothing rollers 302 include a bore 320 and a shaped portion 322. The bore 320 includes openings 324 disposed at each end of the smoothing roller 302 configured to receive the bearings 314 therein. The openings 324 are configured to engage the bearings 314 and to inhibit inward movement of the bearings 314 (i.e., inhibit the upper bearings 314 from moving downward and inhibit the lower bearings 314 from moving upward).

The shaped portion 322 of the smoothing roller 302 is configured to engage at least a portion of the necked portion 204 of the article, such as the radiused portion 204*a* or the tapered portion 204*b* (see FIG. 2B). In the illustrated embodiment of FIGS. 3 and 4, the shaped portion 322 is configured to engage only the radiused portion 204*a* and smooth witness marks 306 thereon. The shaped portion 322 includes a smoothing portion 322*a* and a feathered portion 322*b*. The smoothing portion 322*a* has a complementary shape to a desired shape of the neck portion 204 being smoothed. For example, the smoothing portion 322*a* of the illustrated embodiment is radiused such that engagement of the smoothing portion 322*a* with the radiused portion 204*a* of the article moves material from the raised "peaks" of the witness marks 206 to the "valleys" between the witness marks 206. This results in a generally smooth surface of the article along the smoothing portion 322*a* of the smoothing roller 302. The feathered portion 322*b* is configured to inhibit the formation of additional witness marks by the smoothing roller 302. The feathered portion 322*b* generally recedes from the desired shape of the article in a gradual nature such that displaced material is smoothly incorporated into the shape of the article adjacent the engaged portions.

Formation of a smooth-necked article 200*c* using a turret head assembly 300 according to aspects of the present disclosure will now be described by way of an example cycle of operation. The turret head assembly 300 is incorporated into one of the machines in the machine line 100. A necked article 200*b* having witness marks 206 thereon is received by a pocket of the turret starwheel. While the turret starwheel continuously rotates about a turret starwheel axis, the turret head assembly 300 engages the necked article 200*b* to produce a smooth-necked article 200*c*. In some embodiments, the necked article 200*b* is stationary and the turret head assembly 300 is axially advanced along the turret-head axis to engage the necked article 200*b* using, for example, a cam-follower arrangement. In some embodiments, the turret head assembly 300 is axially stationary and the necked article 200*b* is axially advanced along the turret-head axis to engage the turret head assembly 300 using, for example, a cam-follower arrangement. In some embodiments, both the necked article 200*b* and the turret head assembly 300 are axially advanced along the turret-head axis to engage the necked article 200*b* with the smoothing rollers 302.

During engagement, the turret head assembly 300 rotates about the turret-head axis. This rotational movement of the turret head assembly 300 causes the smoothing rollers 302 to freely rotate about their respective roller support members 304. During rotation of the turret head assembly 300, the smoothing portion 322*a* of the smoothing rollers 302 engages the witness marks 206 to smooth the necked article 200*b* by moving material away from the peaks of the witness marks 206. In some embodiments, the turret head assembly 300 is rotated about the turret-head axis by an independent motor. In some embodiments, the turret head assembly 300 is in a planetary gear configuration such that rotation of the forming turret drives rotation of the turret head assemblies 300 mounted thereon. In some embodiments, the turret head assembly 300 continuously rotates during axial movement of the turret head assembly 300 and/or the necked article 200*b*. Beneficially, such continuous rotation may lead to more consistent smoothing of the witness marks 206. It is believed that more consistent smoothing is produced by more gradual engagement of the smoothing rollers 302 with the witness marks 206.

Beneficially, the engagement of the smoothing rollers 302 with the smooth-necked article 200*c* produces a force on the smooth-necked article 200*c* away from the turret head assembly 300. This force aids in unloading of the smooth-necked article 200*c* without the necessity of additional knockouts or similar mechanisms.

Figure 5:
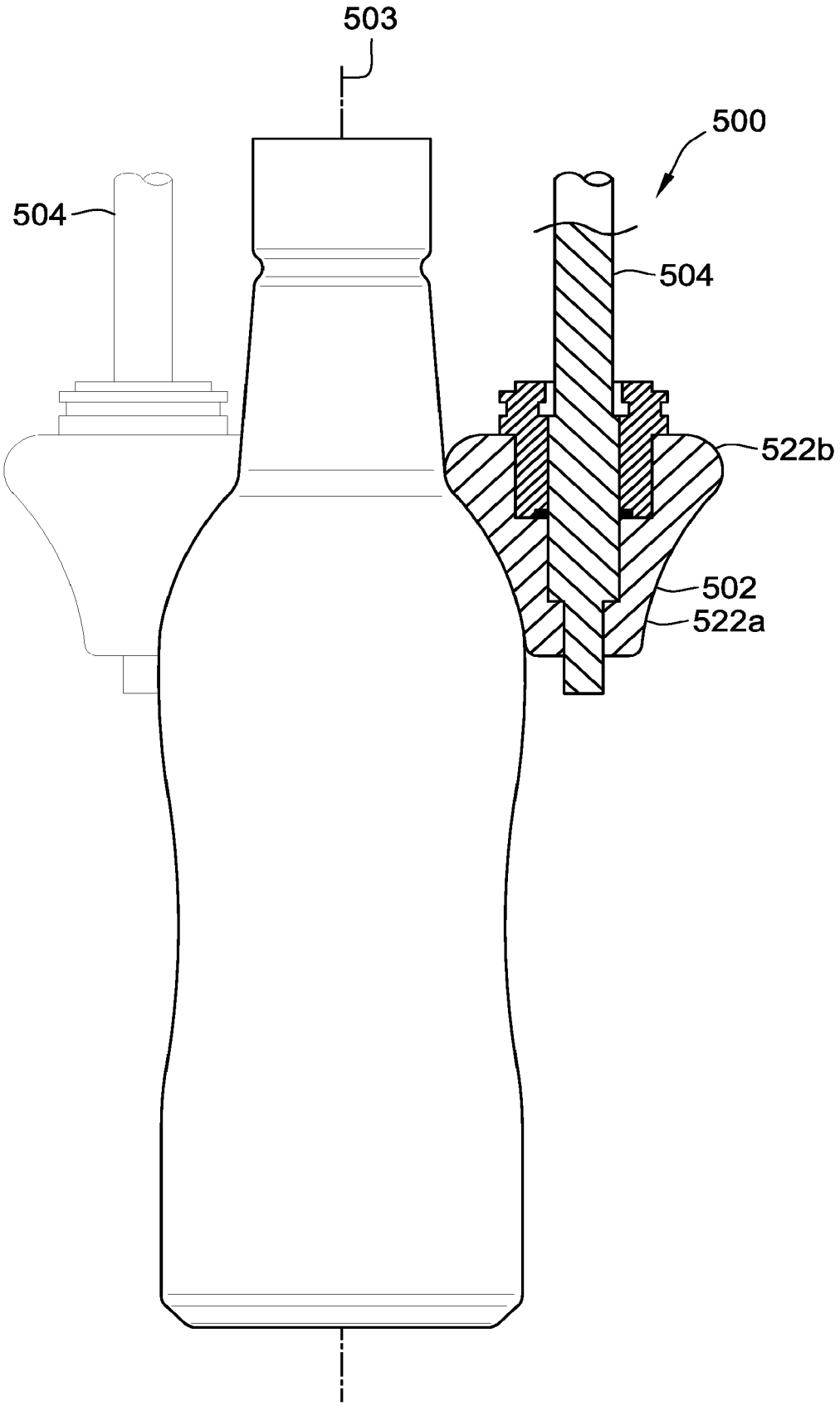
FIG. 5 illustrates a cross-sectional view of a smoothing roller configuration according to further aspects of the present disclosure.

Referring now to FIG. 5, a cross-sectional view of a smoothing roller configuration 500 is shown according to further aspects of the present disclosure. In the illustrated embodiment, the roller support members 504 are disposed generally parallel to the turret-head axis 503. Smoothing rollers 502 include a smoothing portion 522*a* and a feathered portion 522*b*. The smoothing portion 522*a* defines a shape generally similar to the smoothing portion 322*a* of FIG. 3, but the shape of the smoothing rollers 502 of FIG. 5 is different due to the orientation of the roller support members 504. Additionally, the overall diameter of the smoothing roller configuration 500 is greater than the smoothing roller configuration of FIG. 3 because of the roller support members 504 being generally parallel to the turret-head axis 503.

Figure 6:
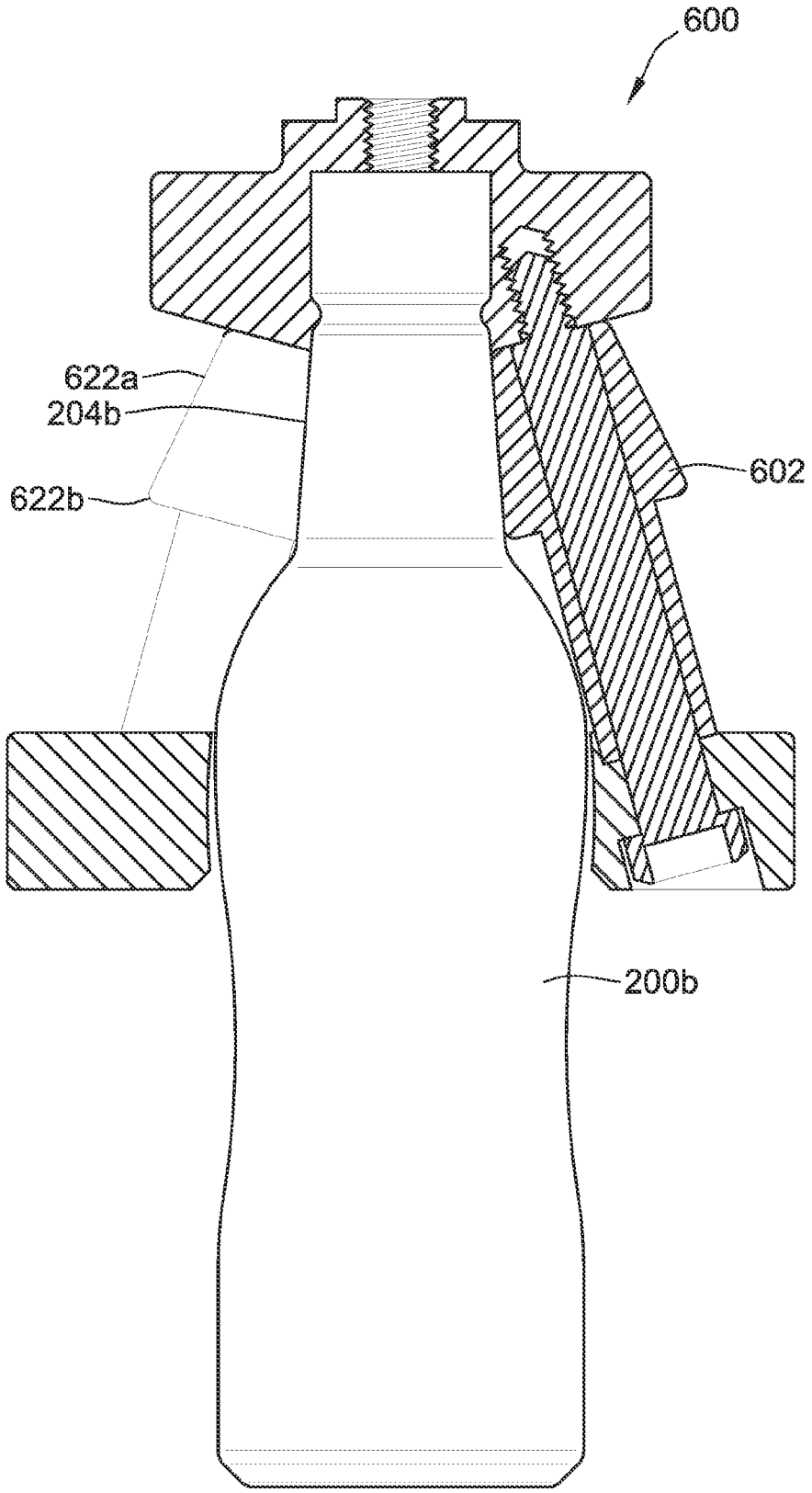
FIG. 6 illustrates a cross-sectional view of a smoothing roller configuration according to yet further aspects of the present disclosure.

Referring now to FIG. 6, a cross-sectional view of a smoothing roller configuration 600 is shown according to another embodiment. In the illustrated embodiment, the smoothing rollers 602 are configured to engage the tapered portion of the necked article 200*b*. The smoothing rollers 602 include a smoothing portion 622*a* and a feathered portion 622*b*. The smoothing portion 622*a* is configured to engage and smooth witness marks 206 disposed on the tapered portion 204*b* of the neck portion 204. The feathered portion 622*b* is configured similarly to the feathered portion 322*b* described above with respect to FIGS. 3 and 4.

Figure 7:
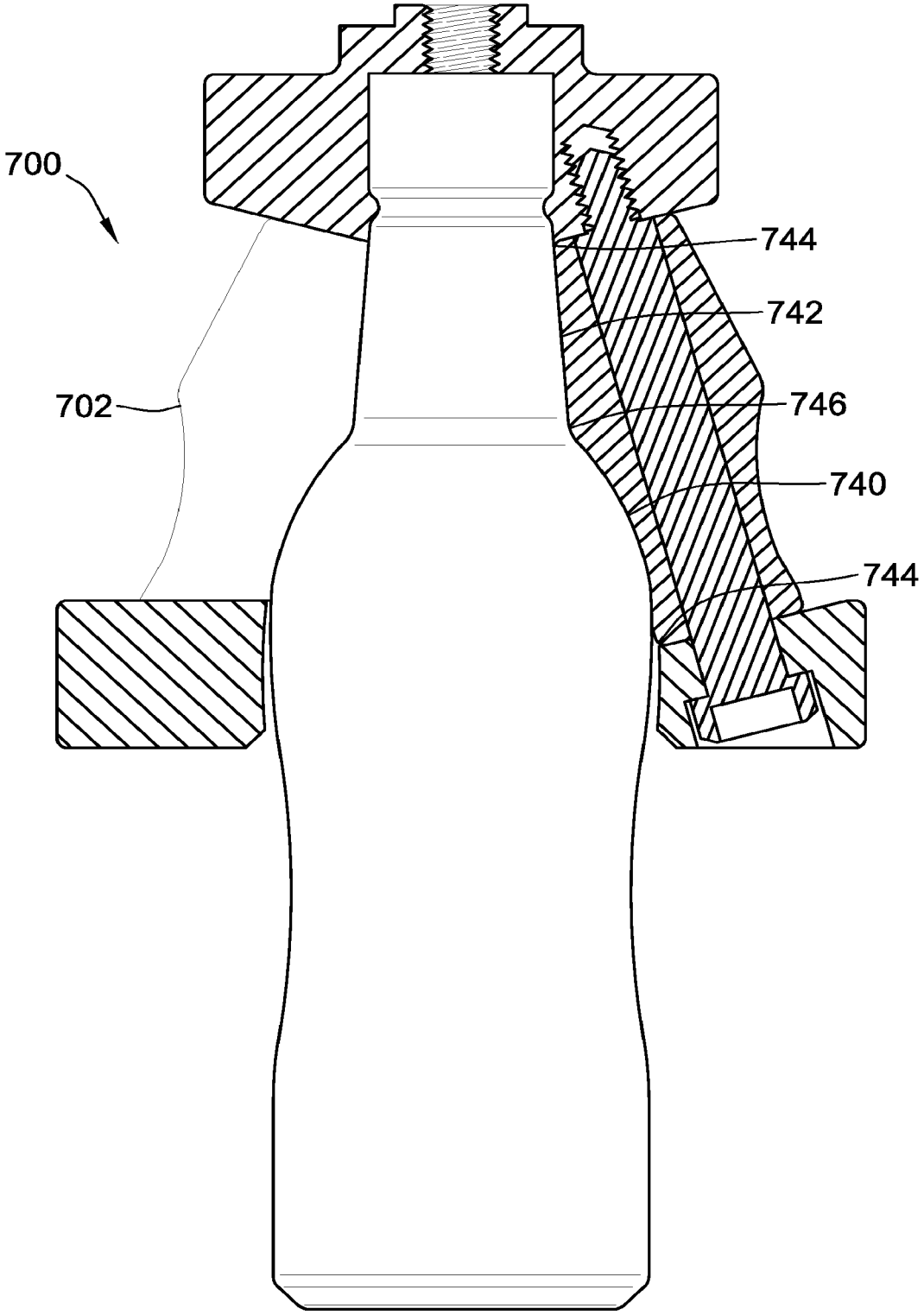
FIG. 7 illustrates a cross-sectional view of a smoothing roller configuration according to still further aspects of the present disclosure.

Referring now to FIG. 7, a cross-sectional view of a smoothing roller configuration 700 is shown according to yet another embodiment. In the illustrated embodiment, the smoothing rollers 702 are configured to engage both the radiused portion 204*a* and the tapered portion 204*b* of the necked article 204*b*. The smoothing rollers 702 include a first smoothing portion 740, a second smoothing portion 742, feathered portions 744, and a transition portion 746 between the first and second smoothing portions 740, 742. The first smoothing portion 740 is configured to engage and smooth witness marks 206 on the radiused portion 204*a* of the necked article 200*b*. The second smoothing portion 742 is configured to engage and smooth witness marks 206 on the tapered portion 204*b* of the necked article 200*b*. The feathered portions 744 are configured similar to the feathered portions 322*a* described above with respect to FIGS. 3 and 4.

The transition portion 746 is configured to allow for movement of material away from the peaks of the witness marks 206 on the radiused and tapered portions 204*a*, 204*b*. In some embodiments, the transition portion 746 does not engage the necked article 200*b*. Instead, the transition portion 746 is disposed a distance away from the desired shape of the necked article 200*b* to provide an area for displaced material to collect. Beneficially, by not engaging the necked article 200*b*, the transition portion 746 will generally not create additional witness marks 206 on the neck portion 204 between the radiused and tapered portions 204*a*, 204*b*.

Beneficially, turret head assemblies disclosed herein can be added to existing modules in an existing machine line 100. Beneficially, the free-spinning of the smoothing rollers contributes to increased longevity of the turret head assembly and decreased likelihood of creating additional aberrations as compared to tooling or non-rotational members.

It is contemplated that the smoothing of the necked portion 204 of the formed article may contribute to increased column strength.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention. It is also contemplated that additional embodiments according to aspects of the present invention may combine any number of features from any of the embodiments described herein.

What is claimed is:

1. A turret head assembly for forming a necked article having a narrowed neck portion, the narrowed neck portion including a radiused portion extending from a cylindrical body and a tapered portion extending from the radiused portion, the turret head assembly comprising:

at least one smoothing roller, each of the at least one smoothing roller being rotatably mounted on a respective at least one roller support member, each of the at least one smoothing roller having a concave-shaped smoothing portion, a cylindrical upper portion, and a feathered portion bridging the smoothing portion and the upper portion, the smoothing portion having a complimentary shape to a desired shape of the radiused portion of the necked article, the cylindrical upper portion being integral with the feathered portion, the feathered portion having a receding diameter such that the feathered portion is configured to gradually recede from the necked article such that the feathered portion and the upper portion are configured to be spaced away from and upper portion of the necked article;

an upper ring member and a lower ring member, the upper and lower ring members including respective apertures located in the centers thereof, the at least one roller support member extending between the upper ring member and the lower ring member; and a turret head-assembly support member defining a turret-head axis, the turret head-assembly support member extending through the aperture in the upper ring member, wherein the axis of each of the at least one roller support member is disposed at an angle relative to the turret head-assembly support member and the turret-head axis.

2. The turret head of claim 1, wherein the at least one smoothing roller freely rotates about a roller axis defined by the at least one roller support member.

3. The turret head assembly member of claim 1, further comprising at least two ring-spacing members extending between the upper ring member and the lower ring member.

4. The turret head assembly of claim 1, wherein the at least one roller support member is mounted on the upper and lower ring members.

5. The turret head assembly of claim 1, wherein the turret head-assembly support member is configured to support the turret head assembly on a forming turret.

6. The turret head assembly of claim 1, wherein the turret head assembly is configured to rotate about the turret-head axis.

7. The turret head assembly of claim 3, wherein the at least two ring-spacing members are disposed parallel to the turret head-assembly support member.

8. The turret head assembly of claim 1, wherein the diameter of the feathered portion is greater than a diameter of the cylindrical upper portion.

9. A method of forming a necked article, the method comprising:

engaging the necked article having witness marks thereon by a turret head assembly, the necked article having a cylindrical body, a tapered neck portion, and a radiused portion bridging the cylindrical body and the tapered portion, the turret head assembly including an upper ring member, a lower ring member, and at least one roller support member extending between the upper ring member and the lower ring member, each of the at least one roller support members having at least one smoothing roller rotatably mounted thereon, the at least one smoothing roller having a concave-shaped smoothing portion, a cylindrical upper portion, and a feathered portion bridging the smoothing portion and the upper portion, the smoothing portion having a complementary shape to a desired shape of the radiused portion of the necked article, the cylindrical upper portion being integral with the feathered portion, the feathered portion having a receding diameter such that the feathered portion is configured to gradually recede from the necked article such that the feathered portion and the upper portion are configured to be spaced away from an upper portion of the necked article;

rotating the turret head assembly about a turret-head axis such that the at least one smoothing roller freely rotates about the respective at least one roller support member; and engaging the smoothing portion of the at least one smoothing roller with the radiused portion of the necked article, thereby smoothing the witness marks on the radiused portion of the necked article, wherein the axis of each of the at least one roller support member is disposed at an angle relative to the turret head-assembly support member and the turret-head axis.

10. The method of claim 9, further comprising receiving into a pocket of a turret starwheel the necked article having the witness marks thereon, the turret starwheel continuously rotating about a turret starwheel axis while the turret head assembly engages the necked article.

11. The method of claim 9, wherein the turret head assembly further includes at least two ring-spacing members extending between the upper ring member and the lower ring member, and a turret head-assembly support member defining the turret-head axis.

12. The method of claim 9, wherein the necked article is stationary, the method further comprising axially advancing the turret head assembly along the turret-head axis to engage the necked article.

13. The method of claim 9, wherein the turret head assembly is axially stationary, the method further comprising axially advancing the necked article along the turret-head axis to engage the turret head assembly.

14. The method of claim 9, wherein the turret head assembly is incorporated into a machine line.

15. The method of claim 9, wherein the turret head assembly is configured to continuously rotate.

16. Method of claim 9, wherein the diameter of the feathered portion is greater than a diameter of the cylindrical upper portion.

* * * * *